US008837105B2

(12) United States Patent
Koo

(10) Patent No.: US 8,837,105 B2
(45) Date of Patent: Sep. 16, 2014

(54) ELECTROSTATIC DISCHARGING APPARATUS AND FINANCIAL APPARATUS

(75) Inventor: Kun Hyung Koo, Gyeonggi-do (KR)

(73) Assignee: LG CNS Co., Ltd., Seoul (KR)

( * ) Notice: Subject to any disclaimer, the term of this patent is extended or adjusted under 35 U.S.C. 154(b) by 49 days.

(21) Appl. No.: 13/606,955

(22) Filed: Sep. 7, 2012

(65) Prior Publication Data

US 2013/0063856 A1 Mar. 14, 2013

(30) Foreign Application Priority Data

Sep. 8, 2011 (KR) ..... 10-2011-0090980

(51) Int. Cl.

| | |
|---|---|
| ***H05F 3/00*** | (2006.01) |
| ***B65H 5/06*** | (2006.01) |
| ***G07D 11/00*** | (2006.01) |
| ***H05F 3/02*** | (2006.01) |

(52) U.S. Cl.

CPC .... *G07D 11/0018* (2013.01); *B65H 2301/5133* (2013.01); *B65H 5/062* (2013.01); *B65H 2404/654* (2013.01); *B65H 2404/561* (2013.01); *H05F 3/02* (2013.01); *B65H 2701/1912* (2013.01)

USPC ..... 361/212

(58) Field of Classification Search

USPC ..... 361/212

See application file for complete search history.

(56) References Cited

U.S. PATENT DOCUMENTS 7,136,271 B2 * 11/2006 Oh et al. ..... 361/221

FOREIGN PATENT DOCUMENTS

| | | | |
|---|---|---|---|
| JP | 2000-038246 | A | 2/2000 |
| KR | 10-2003-0027620 | A | 4/2003 |
| KR | 10-0722876 | | 5/2007 |
| KR | 10-2007-0118384 | | 12/2007 |

OTHER PUBLICATIONS

Office Action dated Aug. 13, 2012 in Korean Application No. 10-2011-0090980, filed Sep. 8, 2011.

Notice of Allowance dated Nov. 20, 2012 in Korean Application No. 10-2011-0090980, filed Sep. 8, 2011.

* cited by examiner

*Primary Examiner* — Stephen W Jackson

(74) *Attorney, Agent, or Firm* — Saliwanchik, Lloyd & Eisenschenk

(57) ABSTRACT

Provided is an electrostatic discharging apparatus, which comprises a rotation shaft, a transfer roller, and an electrostatic discharging member. The rotation shaft transmits driving force. The transfer roller is disposed on the rotation shaft to transfer a medium. The electrostatic discharging member is disposed on the rotation shaft to rotate together with the rotation shaft, and comprises a plurality of brushes for removing static electricity.

18 Claims, 7 Drawing Sheets

ELECTROSTATIC DISCHARGING APPARATUS AND FINANCIAL APPARATUS

CROSS-REFERENCE TO RELATED APPLICATION

This application claims the benefit under 35 U.S.C. §119 of Korean Patent Application No. 10-2011-0090980, filed Sep. 8, 2011, which is hereby incorporated by reference in its entirety.

BACKGROUND

The present disclosure relates to an electrostatic discharging apparatus and a financial apparatus.

Financial apparatuses automatically process a financial transaction according to customer's demands. Financial apparatuses may deposit/withdraw media (such as paper money, checks, securities, and gift certificates), or automatically transfer the media.

Such a financial apparatus comprises a medium entrance for depositing/withdrawing a medium, and a medium introduced through the medium entrance is stored in a medium storage. The medium storage comprises: a temporary storage in which a medium inserted by a user is temporarily stored; a cassette in which a medium is stored; and a collector in which an abnormal medium is stored.

A medium in a typical financial apparatus is moved by means of frictional force generated between the medium and members such as rollers. In this case, friction between the medium and the members may generate static electricity. A foreign substance is easily attached to the medium by the generated static electricity, so as to contaminate the medium or inhibit the medium from being efficiently transferred, thereby jamming the financial apparatus.

BRIEF SUMMARY

Embodiments provide an electrostatic discharging apparatus and a financial apparatus.

In one embodiment, an electrostatic discharging apparatus comprises: a rotation shaft for transmitting driving force; a transfer roller disposed on the rotation shaft to transfer a medium; and an electrostatic discharging member disposed on the rotation shaft to rotate together with the rotation shaft, and comprising a plurality of brushes for removing static electricity.

In another embodiment, a financial apparatus comprises: a transfer path along which a medium is transferred; a transfer roller disposed on the transfer path to transfer the medium; an electrostatic discharging member comprising a brush for removing static electricity generated during the transfer of the medium, wherein the brush being inhibited from contacting the medium during the transfer of the medium; and a rotation shaft connected to the electrostatic discharging member.

The details of one or more embodiments are set forth in the accompanying drawings and the description below. Other features will be apparent from the description and drawings, and from the claims.

DETAILED DESCRIPTION

Figure 1:
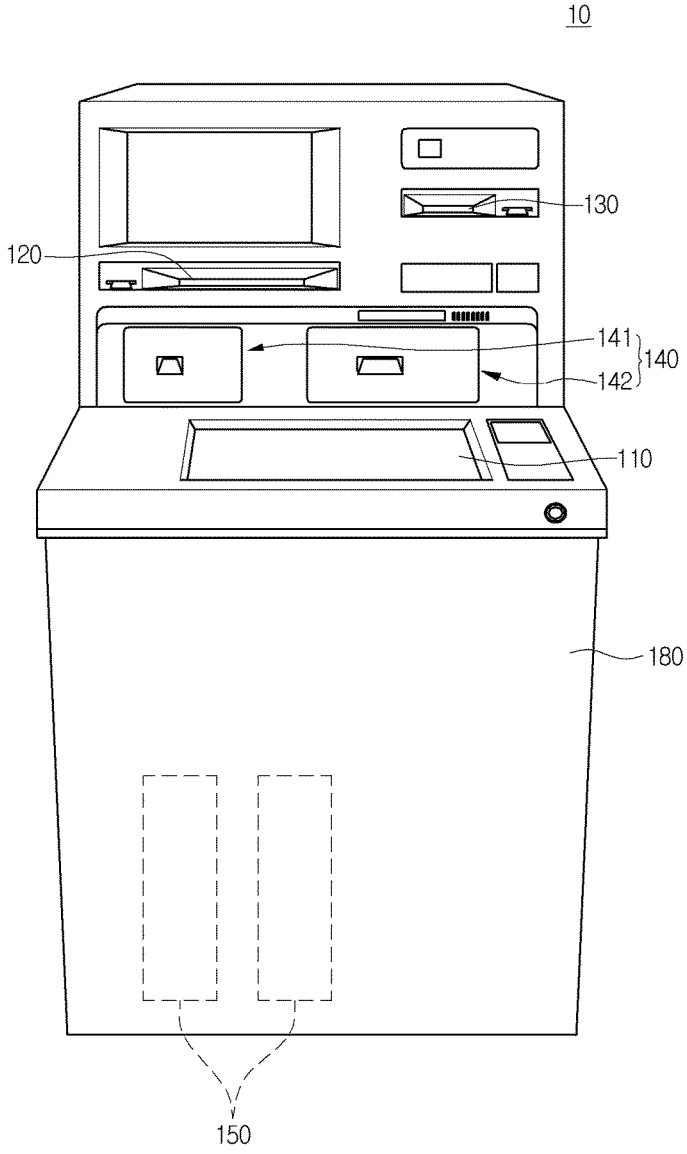
FIG. 1 is a perspective view illustrating a financial apparatus according to a first embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial apparatus according to embodiments is an apparatus that performs financial businesses, i.e., medium processing comprising processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial apparatus may comprise an automatic teller machine (ATM) such as a cash dispenser (CD) or a cash recycling device. However, the financial apparatus is not limited to the above-described examples. For example, the financial apparatus may be an apparatus for automatically performing the financial businesses such as a financial information system (FIS).

Hereinafter, assuming that the financial apparatus is the ATM, an embodiment will be described. However, this assumption is merely for convenience of description, and technical idea of the present disclosure is not limited to the ATM.

Figure 2:
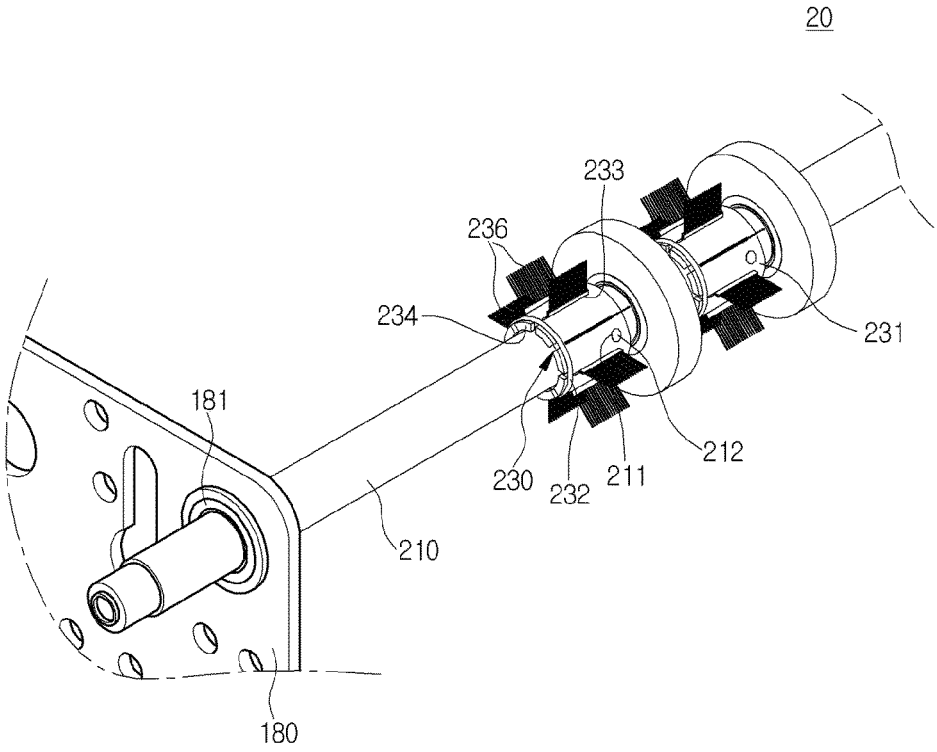
FIG. 2 is a perspective view illustrating an electrostatic discharging apparatus according to the first embodiment.

FIG. 1 is a perspective view illustrating a financial apparatus according to a first embodiment. FIG. 2 is a perspective view illustrating an electrostatic discharging apparatus according to the first embodiment.

Referring to FIGS. 1 and 2, a financial apparatus 10 according to the first embodiment may comprise: an input part 110 by which a user performs a financial process; a bankbook entrance 120 through which a bankbook is put in and taken out; a card entrance 130 through which an integrated circuit (IC) card for a financial process is put in and taken out; a check entrance 141 through which a check is put in and taken out; and a paper money entrance 142 through which a paper money is put in and taken out.

One or more of the bankbook entrance 120, the card entrance 130, the check entrance 141, and the paper money entrance 142 may be removed in the specification. Hereinafter, the check entrance 141 and the paper money entrance 142 are commonly referred to as a media entrance.

The financial apparatus 10 may comprise an electrostatic discharging apparatus 20 for removing static electricity from a medium. The electrostatic discharging apparatus 20 may be disposed in a transfer path along which a medium is transferred, and comprise a rotation shaft 210, a first transfer roller 220, and an electrostatic discharging roller 230 (or an electrostatic discharging member).

The rotation shaft 210 may be rotatably fixed to a frame 180 disposed within the financial apparatus 10. A bearing 181 or bushing may be disposed between the rotation shaft 210 and the frame 180. In this case, the rotation shaft 210 may be rotated by a driving source (not shown) disposed within the financial apparatus 10.

Thus, the rotation shaft 210 is electrically connected to the frame 180 that is connected to a ground. Since static electricity flows to the ground via the electrostatic discharging apparatus 20 and the frame 180, static electricity generated while a medium is transferred can be effectively removed.

The first transfer roller 220 is disposed on the rotation shaft 210 to transfer a medium. The first transfer roller 220 is rotated by the rotation shaft 210, and pushes a medium by means of frictional force generated therebetween, so as to transfer the medium.

The electrostatic discharging roller 230 may be disposed on the rotation shaft 210 to rotate interactively with the first transfer roller 220, and comprise brushes 236. The electrostatic discharging roller 230 may remove static electricity generated from a medium transferred by the first transfer roller 220, by using the brushes 236. The brushes 236 may be formed of a flexible material. Although both the first transfer roller 220 and the electrostatic discharging roller 230 are disposed on the rotation shaft 210 in the current embodiment, only the electrostatic discharging roller 230 may be disposed on the rotation shaft 210 with the first transfer roller 220 disposed on another rotation shaft.

The first transfer roller 220 may be provided in plurality on the rotation shaft 210. The electrostatic discharging roller 230 may be provided in plurality on the rotation shaft 210. When the first transfer roller 220 is provided in plurality, a medium can be inhibited from being folded or bent while being transferred.

A distance between a center of the rotation shaft 210 and an end of at least one of the brushes 236 may be smaller than a radius of the first transfer roller 220. Thus, the brushes 236 of the electrostatic discharging roller 230 keep a distance from a medium transferred by the first transfer roller 220, so that the outer surface of the medium and the brushes 236 are protected from each other. That is, while a medium is transferred, one or more of the brushes 236 are inhibited from contacting the medium.

Particularly, the end of the brushes 236 of the electrostatic discharging roller 230 may be spaced apart from the edge of the first transfer roller 220 by about 0.5 mm to about 1 mm in a direction perpendicular to an axis of the rotation shaft 210.

Figure 3:
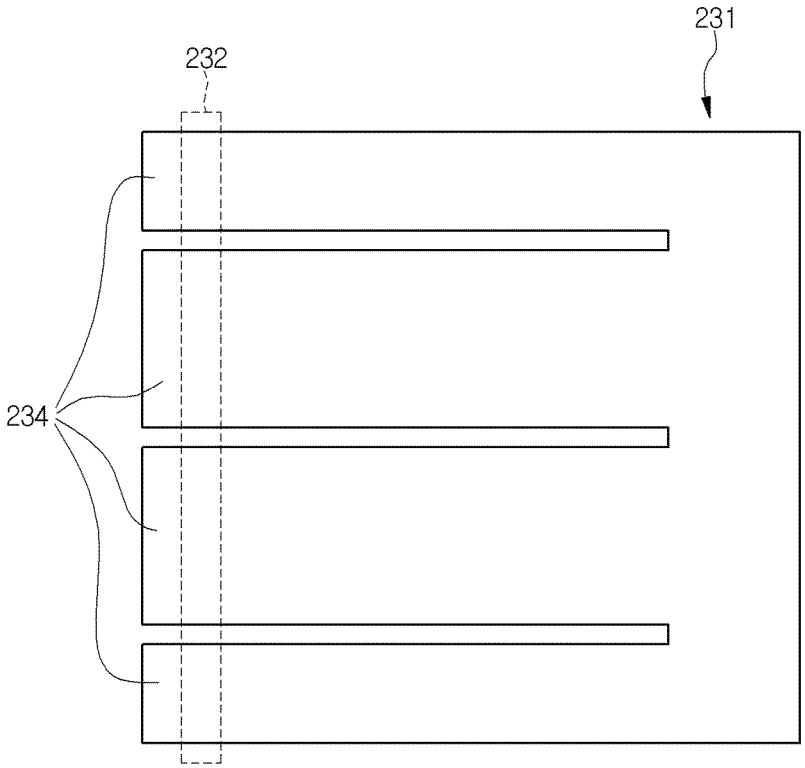
FIG. 3 is a side view illustrating the electrostatic discharging roller according to the first embodiment.
Figure 4:
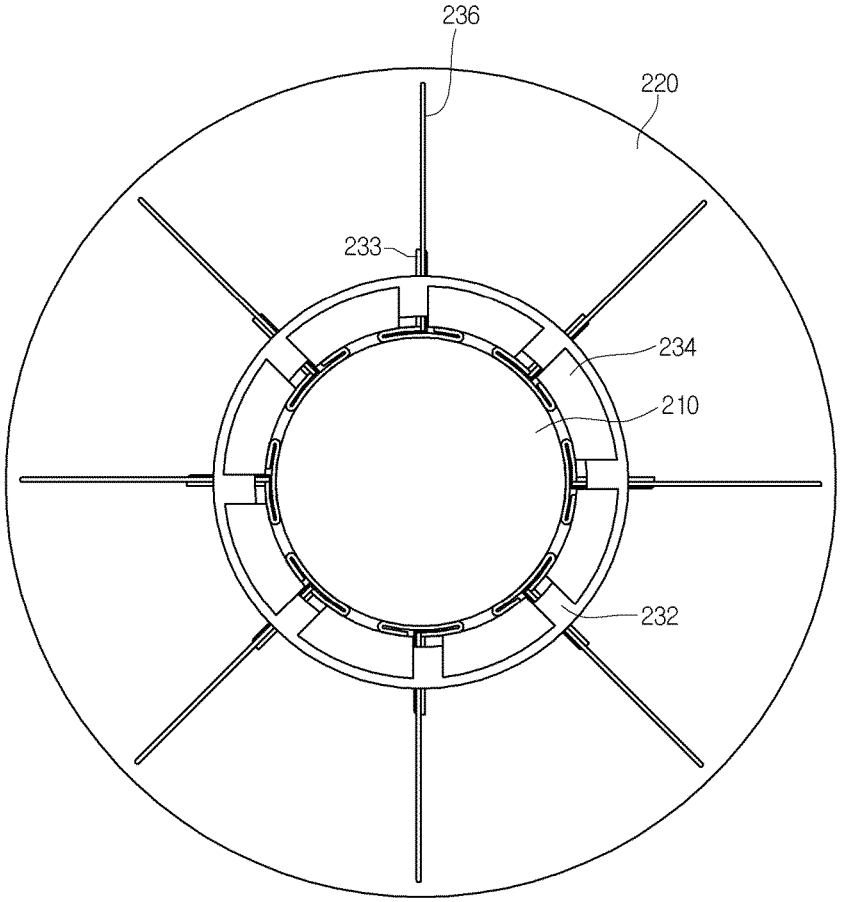
FIG. 4 is a front view illustrating the electrostatic discharging roller of FIG. 3.
Figure 5:
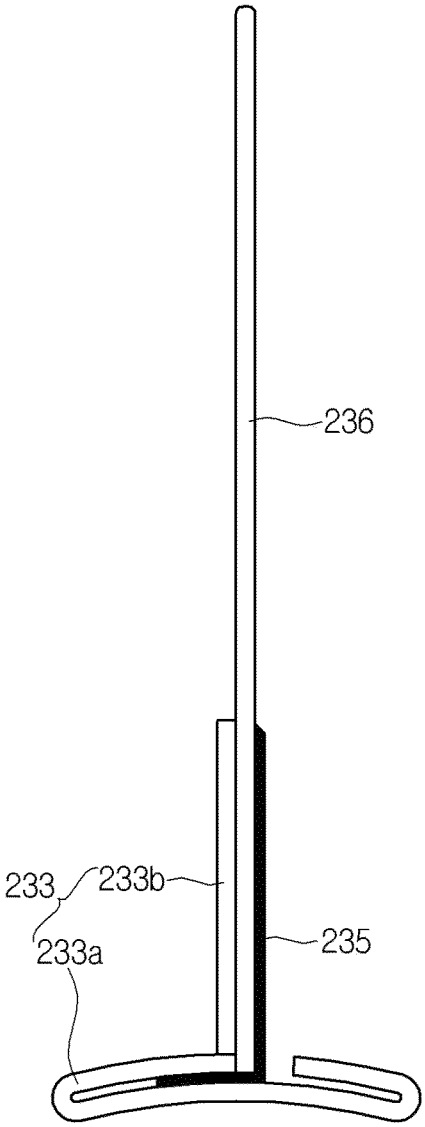
FIG. 5 is a front view illustrating a brush fixing part according to the first embodiment.

FIG. 3 is a side view illustrating the electrostatic discharging roller according to the first embodiment. FIG. 4 is a front view illustrating the electrostatic discharging roller of FIG. 3. FIG. 5 is a front view illustrating a brush fixing part according to the first embodiment.

Referring to FIGS. 3 and 5, the electrostatic discharging roller 230 may comprise a shaft fixing part 231, an elastic ring 232, and brush fixing parts 233. The shaft fixing part 231 has a ring shape in which the rotation shaft 210 is fitted. An inner diameter of the shaft fixing part 231 may be greater than an outer diameter of the rotation shaft 210. That is, a certain space may be formed between the shaft fixing part 231 and the rotation shaft 210. First parts 233*a* of the brush fixing parts 233 to be described later may be inserted in the space formed between the shaft fixing part 231 and the rotation shaft 210. In this case, the first parts 233*a* of the brush fixing parts 233 may be inserted into the space formed between the shaft fixing part 231 and the rotation shaft 210, in an extension direction of the rotation shaft 210.

Fixing holes 211 may be individually disposed in the rotation shaft 210 and the shaft fixing part 231. Fixing pins 212 are inserted in the fixing holes 211 of the shaft fixing part 231 and the fixing holes 211 of the rotation shaft 210 to inhibit the shaft fixing part 231 from spinning with no traction about the rotation shaft 210.

Referring to FIGS. 3 and 4, the shaft fixing part 231 may comprise extensions 234 extending in the extension direction of the rotation shaft 210, and the extensions 234 may be spaced apart from one another. Second parts 233*b* of the brush fixing parts 233 may be inserted in gaps disposed between the extensions 234. In this case, the second part 233*b* of the brush fixing part 233 may be inserted between two neighboring ones of the extensions 234 in the extension direction of the rotation shaft 210.

That is, the shaft fixing part 231 has a plurality of gaps extending in the extension direction of the rotation shaft 210, and the second parts 233*b* of the brush fixing parts 233 are inserted in the gaps, respectively.

The extensions 234 have recesses (not shown) in which the elastic ring 232 is inserted. The elastic ring 232 is fitted in the recesses to surround and press the extensions 234, thereby fixing the brush fixing parts 233 inserted in the shaft fixing part 231, to the rotation shaft 210.

That is, elastic force of the elastic ring 232 is applied to the shaft fixing part 231 in a direction to decrease the inner diameter of the shaft fixing part 231, thereby decreasing the gaps between the extensions 234. Thus, the brush fixing parts 233 disposed between the shaft fixing part 231 and the rotation shaft 210 can be securely fixed to the rotation shaft 210 by the elastic force of the elastic ring 232.

While the brush fixing parts 233 are fixed to the rotation shaft 210 by the shaft fixing part 231 in the current embodiment, the brush fixing parts 233 may be coupled to the rotation shaft 210 by an adhesive without using the shaft fixing part 231 in another embodiment.

In this case, since the brush fixing parts 233 are directly fixed to the rotation shaft 210, electrical connection between the brushes 236 and the rotation shaft 210 can be maintained, so that the brushes 236 can efficiently remove static electricity.

The brush fixing parts 233 with the brushes 236 attached thereto are coupled to the shaft fixing part 231. The brush fixing parts 233 may be arrayed in a radial form about the rotation shaft 210, and be formed of a metal such that static electricity generated during transfer of a medium flows to the ground via the brushes 236 and the frame 180.

The brush fixing parts 233 may be slid into the space between the shaft fixing part 231 and the rotation shaft 210, and the gaps between the extensions 234, and be inhibited from being removed by the elastic ring 232.

Referring to FIG. 5, each of the brush fixing parts 233 may comprise: the first part 233*a* having an arc shape and contacting the rotation shaft 210; and the second part 233*b* protruding a certain height from the first part 233*a* and contacting at least one surface of the brush 236. The second part 233*b* extends in a direction perpendicular to the rotation shaft 210, and contacts the brush 236 to maintain a state in which at least one portion of the brush 236 is perpendicular to the rotation shaft 210. Thus, the second parts 233*b* may be referred to as supports for maintaining the positions of the brushes 236.

That is, when the brush fixing parts 233 are fixed to the shaft fixing part 231, the first parts 233*a* of the brush fixing parts 233 are inserted in the space between the shaft fixing part 231 and the rotation shaft 210, and the second parts 233*b* of the brush fixing parts 233 are inserted in the gaps between the extensions 234. Accordingly, the brush fixing parts 233 are protruded out of the shaft fixing part 231.

The brush fixing parts 233 may further comprise adhesive parts 235 to fix the brushes 236 to the brush fixing parts 233. A portion of the adhesive part 235 is adhered to a surface of the brush 236, and another portion thereof is coupled to the brush fixing part 233, thereby fixing the brush 236 to the brush fixing part 233. To this end, a portion of the first part 233*a* of the brush fixing part 233 may be folded in at least two between which the adhesive part 235 can be inserted.

Figure 6:
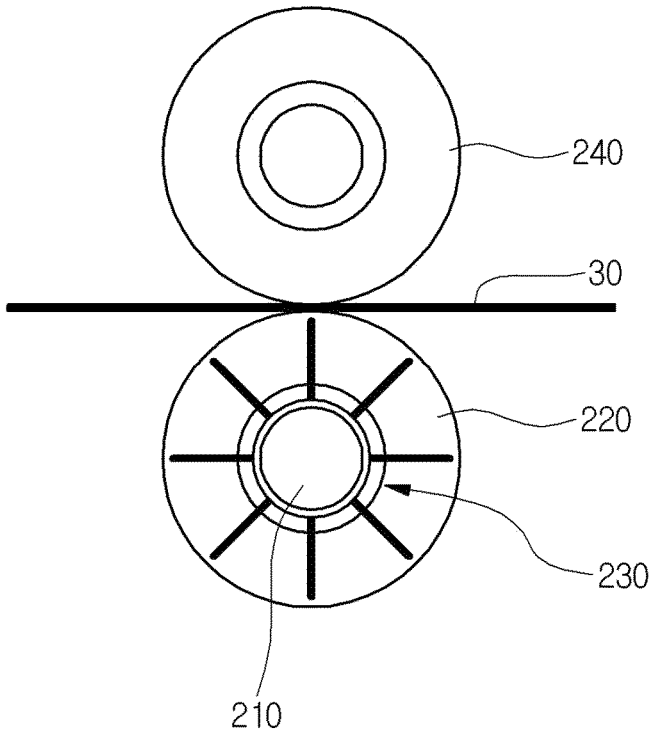
FIG. 6 is a side view illustrating the electrostatic discharging apparatus according to the first embodiment.

FIG. 6 is a side view illustrating the electrostatic discharging apparatus according to the first embodiment.

Referring to FIG. 6, the financial apparatus 10 may further comprise a second transfer roller 240 that is disposed in a position corresponding to the first transfer roller 220 to transfer a medium 30.

The second transfer roller 240 may be spaced a certain distance from the first transfer roller 220, and rotate clockwise or counterclockwise about a fixed rotation shaft to transfer the medium 30. That is, the medium 30 may be transferred between the second transfer roller 240 and the first transfer roller 220, and static electricity may be generated on the medium 30. The generated static electricity may be removed by the electrostatic discharging roller 230.

Figure 7:
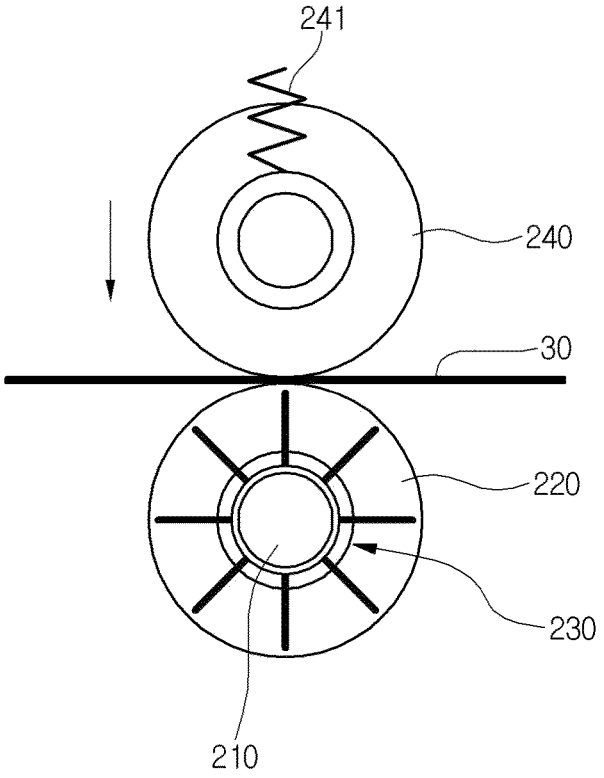
FIG. 7 is a side view illustrating an electrostatic discharging apparatus according to a second embodiment.

FIG. 7 is a side view illustrating an electrostatic discharging apparatus according to a second embodiment.

Referring to FIG. 7, an electrostatic discharging apparatus 20 according to the second embodiment comprises a second transfer roller 240, the position of which may be varied. That is, a rotation shaft of the second transfer roller 240 may not be fixed to a certain position, and the second transfer roller 240 may selectively contact a first transfer roller 220. The electrostatic discharging apparatus 20 may further comprise an elastic member 241 that applies elastic force to the second transfer roller 240 in a direction to bring the second transfer roller 240 into contact with the first transfer roller 220.

That is, the second transfer roller 240 may contact the first transfer roller 220 by the elastic member 241, and the medium 30 may be transferred between the first transfer roller 220 and the second transfer roller 240. Since the elastic force of the elastic member 241 moves the second transfer roller 240 to the first transfer roller 220, when the second transfer roller 240 contacts the medium 30, sufficient frictional force is generated to thereby efficiently transfer the medium 30.

According to the embodiments, since a first transfer roller and an electrostatic discharging roller are disposed on a rotation shaft, not only a medium can be transferred, but also static electricity generated during the transfer of the media can be effectively removed.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or comprise or has) only those elements, or it may comprise (or comprise or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, the claimed invention is defined not by the detailed description of the invention but by the appended claims, and all differences within the scope will be construed as being comprised in the present disclosure.

What is claimed is:

1. An electrostatic discharging apparatus comprising:

a rotation shaft for transmitting driving force;

a transfer roller disposed on the rotation shaft to transfer a medium; and an electrostatic discharging member disposed on the rotation shaft to rotate together with the rotation shaft, and comprising a plurality of brushes for removing static electricity, wherein the electrostatic discharging member comprises:

a plurality of brush fixing parts to which the brushes are coupled; and a shaft fixing part for fixing the brush fixing parts to the rotation shaft, wherein an inner diameter of the shaft fixing part is greater than an outer diameter of the rotation shaft and a portion of the brush fixing part is disposed in a space formed between the shaft fixing part and the rotation shaft.

2. The electrostatic discharging apparatus of claim 1, wherein a distance between a center of the rotation shaft and an end of at least one of the brushes is smaller than a radius of the transfer roller.

3. The electrostatic discharging apparatus of claim 1, wherein the portion of the brush fixing part is inserted into the space formed between the shaft fixing part and the rotation shaft, in an extension direction of the rotation shaft.

4. The electrostatic discharging apparatus of claim 1, wherein the shaft fixing part comprise extensions extended in a direction parallel to the rotation shaft and spaced apart from one another, and a portion of the brush fixing part is inserted in a gap formed between two neighboring ones of the extensions.

5. The electrostatic discharging apparatus of claim 4, wherein the portion of the brush fixing part is inserted into the gap formed between the two neighboring extensions, in a direction parallel to an extension direction of the rotation shaft.

6. The electrostatic discharging apparatus of claim 4, further comprising an elastic ring that surrounds and presses the extensions, thereby fixing the brush fixing parts coupled to the shaft fixing part, to the rotation shaft.

7. The electrostatic discharging apparatus of claim 1, wherein fixing holes are individually disposed in the rotation shaft and the shaft fixing part, and fixing pin passes through the fixing holes, respectively, to fix the shaft fixing part to the rotation shaft.

8. The electrostatic discharging apparatus of claim 1, wherein the brush fixing part comprises:

a first part having an arc shape and contacting the rotation shaft: and a second part protruding a certain height from the first part and contacting a surface of the brush.

9. The electrostatic discharging apparatus of claim 1, further comprising adhesive parts that fix the brushes to the brush fixing parts, respectively.

10. The electrostatic discharging apparatus of claim 9, wherein a portion of the adhesive part is adhered to a surface of the brush, and another portion thereof is coupled to the brush fixing part, thereby fixing the brush to the brush fixing part.

11. The electrostatic discharging apparatus of claim 1, wherein the electrostatic discharging member comprises a brush fixing part to which the brush is coupled, and the brush fixing part is fixed to the rotation shaft by an adhesive.

12. A financial apparatus comprising:

a transfer path along which a medium is transferred;

a transfer roller disposed on the transfer path to transfer the medium;

an electrostatic discharging member comprising a brush for removing static electricity generated during the transfer of the medium, wherein the brush being inhibited from contacting the medium during the transfer of the medium; and a rotation shaft connected to the electrostatic discharging member.

13. The financial apparatus of claim 12, wherein the transfer roller is connected to the rotation shaft.

14. The financial apparatus of claim 12, wherein the electrostatic discharging member comprises a plurality of brushes, and a distance between a center of the rotation shaft and an end of at least one of the brushes is smaller than a radius of the transfer roller.

15. The financial apparatus of claim 14, wherein the electrostatic discharging member comprises:

a plurality of brush fixing parts to which the brushes are coupled; and a shaft fixing part for fixing the brush fixing parts to the rotation shaft.

16. The financial apparatus of claim 15, wherein a portion of the brush fixing part is disposed between the shaft fixing part and the rotation shaft, and another portion of the brush fixing part is disposed in a gap formed in the shaft fixing part.

17. The financial apparatus of claim 16, further comprising an elastic ring that presses the shaft fixing part, thereby fixing the brush fixing parts coupled to the shaft fixing part, to the rotation shaft.

18. The financial apparatus of claim 16, wherein the brush fixing part comprises a support that extends in a direction perpendicular to the rotation shaft and that contacts the brush to maintain a state in which at least one portion of the brush is perpendicular to the rotation shaft.

* * * * *